US011220013B1

(12) United States Patent
Valerio, II

(10) Patent No.: US 11,220,013 B1
(45) Date of Patent: Jan. 11, 2022

(54) FOLDING KNIFE BLADE ENGAGEMENT LOCK

(71) Applicant: Teodoro N. Valerio, II, Montrose, CO (US)

(72) Inventor: Teodoro N. Valerio, II, Montrose, CO (US)

( * ) Notice: Subject to any disclaimer, the term of this patent is extended or adjusted under 35 U.S.C. 154(b) by 0 days.

(21) Appl. No.: 17/004,738

(22) Filed: Aug. 27, 2020

(51) Int. Cl.
*B26B 1/04* (2006.01)

(52) U.S. Cl.
CPC ..... *B26B 1/048* (2013.01)

(58) Field of Classification Search
CPC ..... B26B 1/048
See application file for complete search history.

(56) References Cited

U.S. PATENT DOCUMENTS 7,774,940 B2 8/2010 Frank
8,161,653 B2 4/2012 Nenadic
9,352,473 B2 5/2016 Harvey
9,862,105 B2 1/2018 Liang
9,908,245 B1 3/2018 Tkachenko
9,950,433 B2 4/2018 Demko
10,632,632 B1 4/2020 Demko
2004/0134075 A1* 7/2004 Chu ..... B26B 1/048 30/161
2010/0192381 A1* 8/2010 Sakai ..... B26B 1/048 30/160
2013/0000129 A1* 1/2013 Huang ..... B26B 1/048 30/161
2013/0133205 A1* 5/2013 Lo ..... B26B 1/048 30/160
2016/0354936 A1* 12/2016 Busse ..... B26B 1/048

* cited by examiner

*Primary Examiner* — Stephen Choi
(74) *Attorney, Agent, or Firm* — Harpman + Harpman

(57) ABSTRACT

A folding knife with an improved locking mechanism for a blade pivoting from a closed position to a secure open locked position. A spring urged release locking arm is slidably disposed within the knife handle by guide pins. A locking arm projection is engaged on a blade shank retainment locking pin allowing selective repositioning of the locking pin during operation releasing the blade from closed retained position to fully open and extended lock position upon locking arm movement.

5 Claims, 5 Drawing Sheets

FOLDING KNIFE BLADE ENGAGEMENT LOCK

BACKGROUND OF THE INVENTION

1. Technical Field

This invention relates generally to folding knives and specifically folding pocket knives that provide a compact and safe knife configuration for transport until needed which may be opened and locked into place for use.

2. Description of Prior Art

Prior art folding knives have been developed with a number of different blade locking engagement configurations to define a variety of blade lock and release priorities, see for example U.S. Pat. Nos. 7,774,940, 8,161,653, 9,352,473, 9,862,105, 9,908,245, 9,950,433 and 10,632,632.

In U.S. Pat. No. 7,774,940 a folding knife with puzzle piece locking configuration is disclosed having a matching male and female puzzle portion on the blade shank and heel but respectively.

U.S. Pat. No. 8,161,653 is directed to a folding tool with a rotatable lock mechanism wherein a blade and a pivoted cam member pivot relative to the handle from first and second positions.

U.S. Pat. No. 9,352,473 claims a knife having a locking member with first and second locking mounts to retain the blade in closed and open position respectively by a release push button.

U.S. Pat. No. 9,862,105 illustrates a folding knife with safety device having inner engaging resilient lock sheets with configured slots and blade lock contact elements.

U.S. Pat. No. 9,908,245 discloses a locking mechanism for a folding instrument wherein a stop pin restricts movement of the blade from a first closed to a second open position.

U.S. Pat. No. 9,950,433 shows a dual arm folding blade lock engagement knife with a pair of spring urged dual locking bars engaged on the knife blade with a safety release button therebetween.

Finally, in U.S. Pat. No. 10,632,632 an arm blade engagement lock for a folding knife is disclosed having repositional sliding activation arm that slide and pivot up to release from direct engagement on the blade shank.

SUMMARY OF THE INVENTION

A folding knife locking device having a spring urged self-repositioning safety lock arm engaging a blade shank retainment lock pin from a retained closed blade folded position to a full open blade and extended lock position for use. Locking arm projection provides lock pin engagement points defining fully opened locked and fully closed folded retained position while maintaining constant blade shank lock pin engagement.

DETAILED DESCRIPTION OF THE INVENTION

Figure 1:
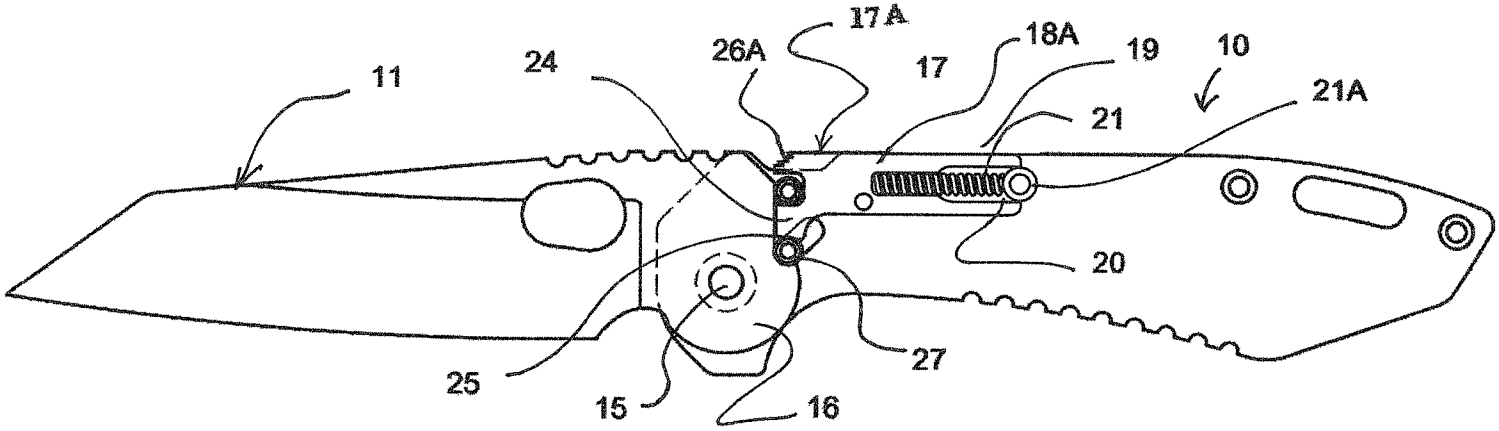
FIG. 1 is a side elevational view of the folding knife of the invention in open locked position with portions broken away.
Figure 2:
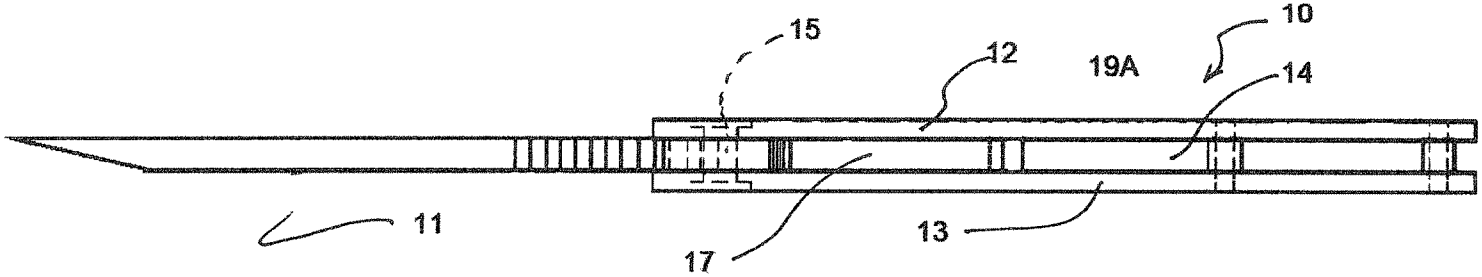
FIG. 2 is a top plan view of the folding knife of the invention.

Referring to FIGS. 1 and 2 of the drawings, a folding knife 10 of the invention can be seen in open unfolded locked position. The knife 10 has a blade 11 pivotally secured between handle portions 12 and 13 with a handle spacer 14 indicated in FIG. 2 of the drawings there between. A blade hinge pin assembly 15 extends through a shank portion 16 of the blade 11 for manual repositioning of the blade within the handle portions 12 and 13 defining a blade knife configuration. A safety release locking arm 17 is movably retained within the handle portions having oppositely disposed affixed guide pins 18A and 18B extending therefrom which are slidably received in corresponding aligned guide pin registration slots GPS in the handle portions 12 and 13 respectively as best seen in FIG. 3 of the drawings.

The safety release locking arm 17 has an elongated bifurcated portion 19 defining a spring retaining opening 20 there between.

A resilient coil spring 21 is positioned within the spring retaining opening 20 against an upstanding spring stop 21A in the handle portion 12 urging the safety release locking arm 17 towards the blade shank 16.

Figure 3:
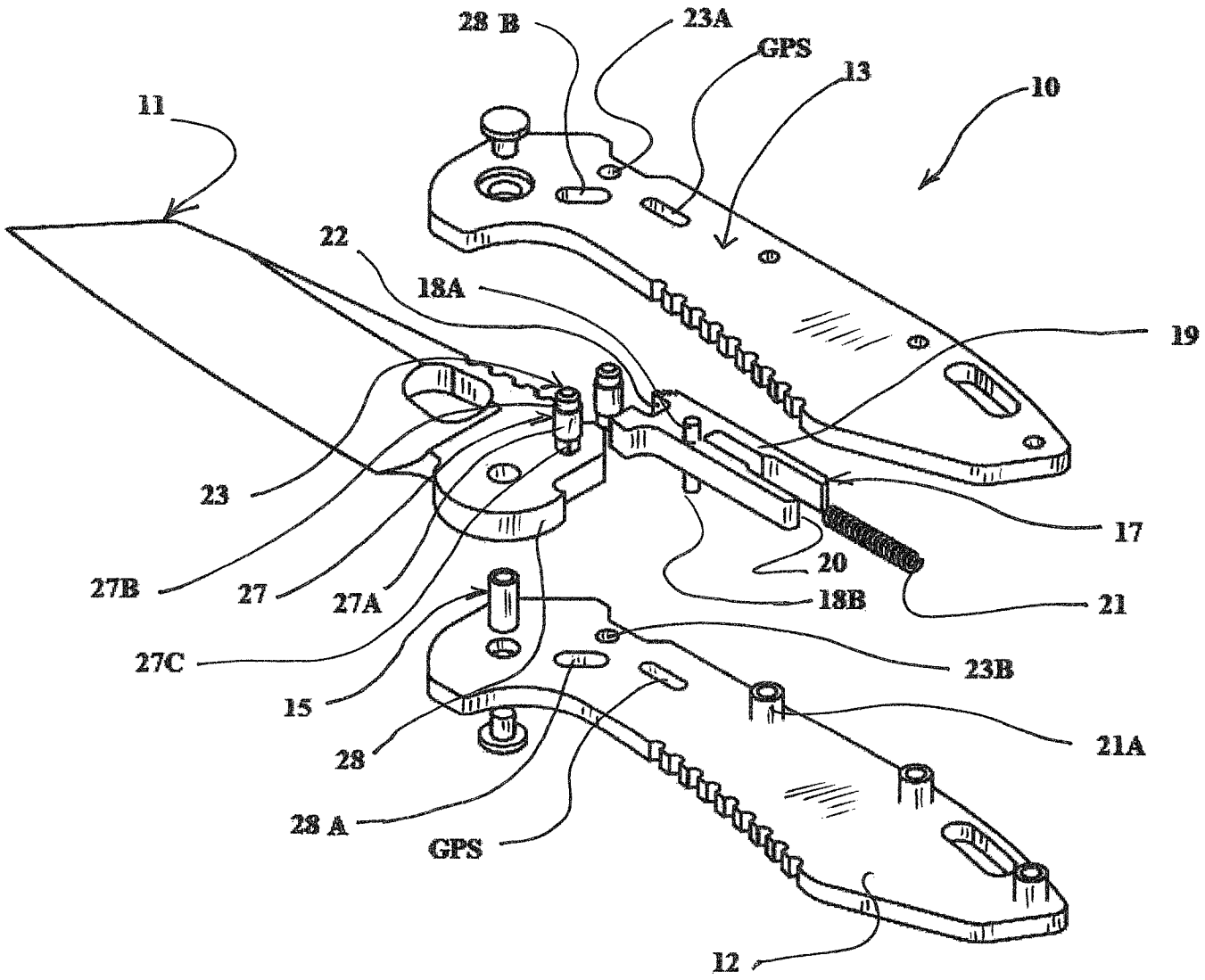
FIG. 3 is a perspective exploded view of the folding knife.
Figure 4:
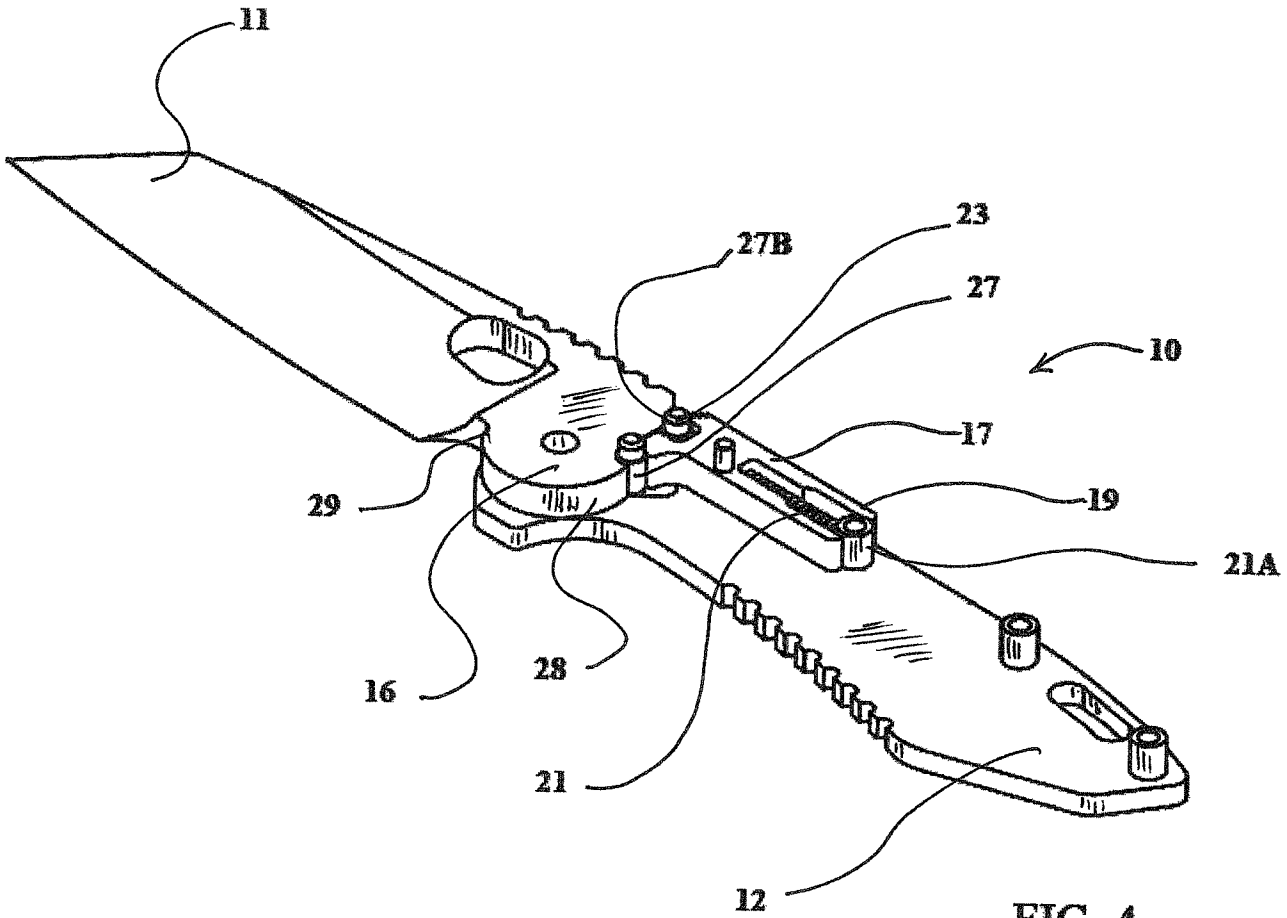
FIG. 4 is a perspective view with portions broken away of the folding knife of the invention in open locked position.

The safety release locking arm 17 has a blade stop pin receiving notch 22 in oppositely disposed spaced relation to the spring receiving opening 20 for select engagement with a blade stop pin 23 secured between the respective handle portions 12 and 13, best seen in FIGS. 3 and 4 of the drawings. A locking arm projection portion 24 depends from the pin receiving notch 22 having a flat edge end surface 25 with an angled return flat bottom edge surface 26 in general spaced parallel relation to the pin receiving notch 22.

The safety release locking arm 17 has an upper surface edge 26 in spaced parallel relation to the spring retaining opening 20 with a textured end angle surface area 26A positioned over the blade stop receiving notch 22 which acts as a user, not shown, engagement surface during use.

A blade locking and retaining pin 27 is movably positioned between a pair of aligned mounting slots 28A and 28B in the respective handle portions 12 and 13. The blade lock retaining pin 27 has a center blade shank engagement portion 27A with oppositely disposed extending slot engagement portions 27B and 27C of reduced diameter, best seen in FIG. 3 of the drawings.

The blade shank 16 has a blade shank locking tab 28 formed by an arcuate end surface of the blade shank 16 and a blade shank retainment notch 29 in spaced relation there about.

It will be seen that when the blade 11 is held in open locked position that the blade locking and release pin 27 which is held against the blade shank locking tab 28 by the return surface 26 of the locking arm projection 24.

Figure 5:
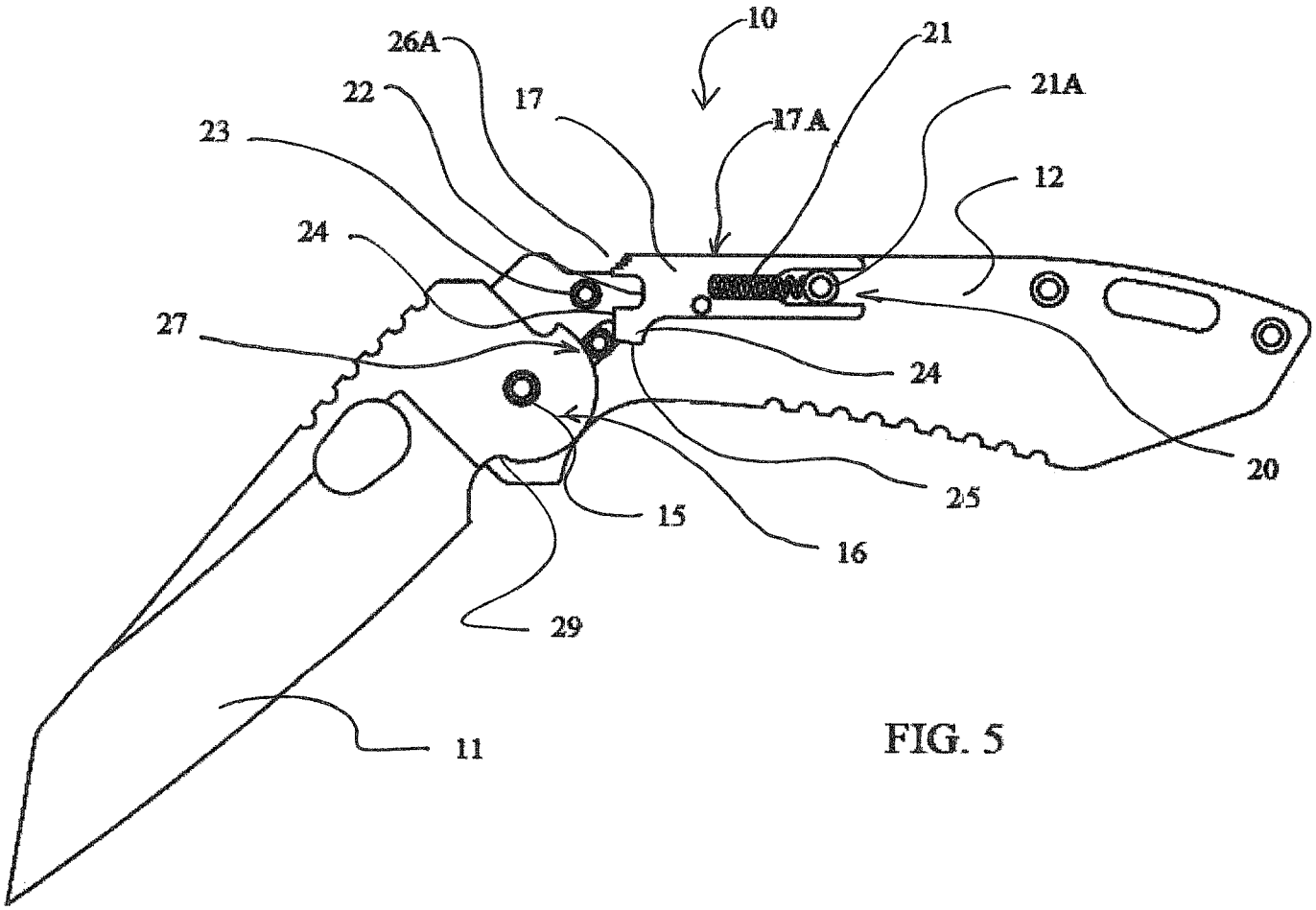
FIG. 5 is a side elevational view of the folding knife in partial open or closed position with portions broken away for illustration.

To release the blade 11 input on the textured front surface 26A of the safety release locking arm 17 is applied against the spring 21 will allow the locking pin 27 to be moved by the rotation of the blade 11 and shank 16 as best seen in FIG. 5 of the drawings.

Figure 6:
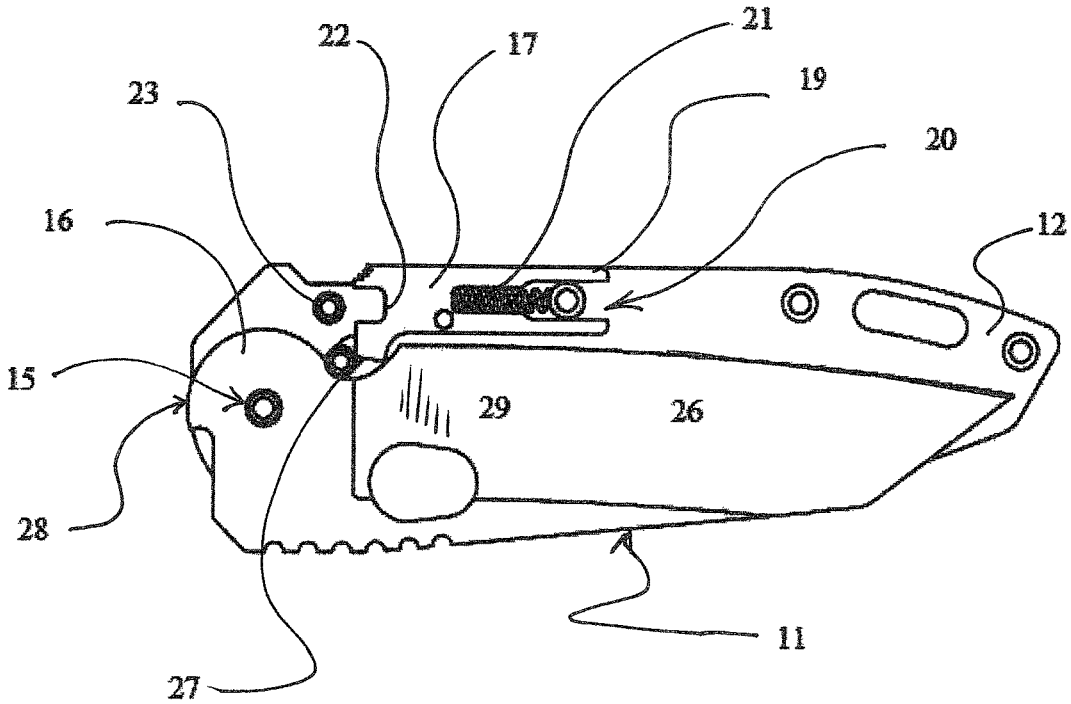
FIG. 6 is a side elevational view of the folding knife in fully closed position with portions broken away.
Figure 7:
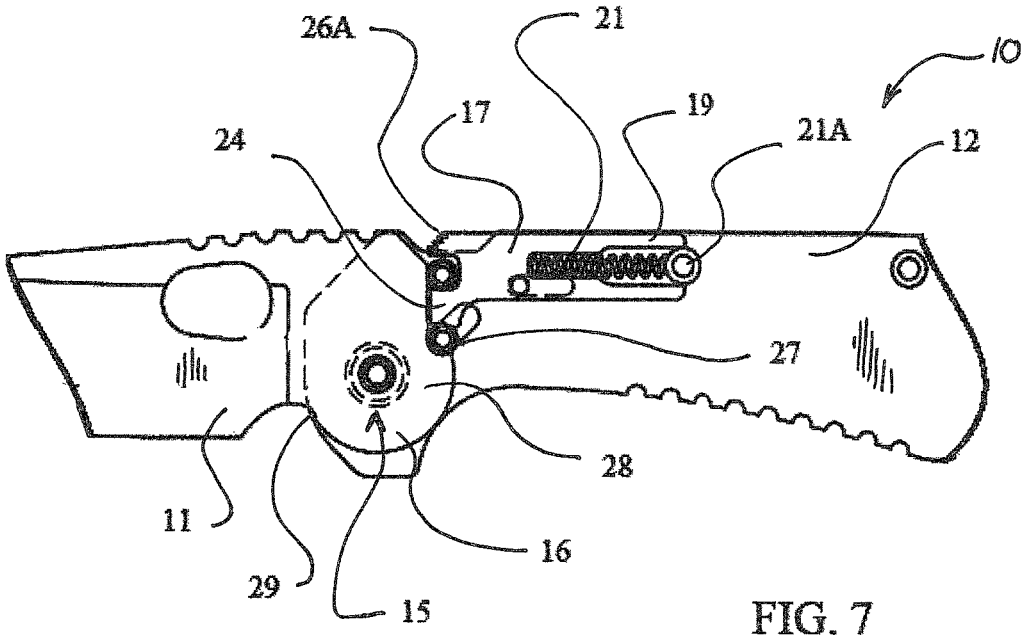
FIG. 7 is an enlarged side elevational view with portions broken away of the folding knife in open locked position.

Once released, the safety release locking arm 17 will maintain contact with the blade locking release pin 27 as the blade shank 16 rotates until being retained within the shank retainment notch 29 as seen in FIG. 6 of the drawings. In this position, the front edge 25 of the locking arm projection 24 is engaging the blade shank locking pin 27 holding the blade in closed position.

It will be evident from the above description that the folding knife 10 provides a safety blade engagement lock and release utilizing spring urged safety release locking arm 17 and a direct engagement repositional blade locking pin 27 to lock and retain the knife blade 11 in secured open lock and retained folded closure position by providing shank positional engagement by controlled contact under safety release locking arm 17 resilient engagement input.

It will thus be seen that a new and novel safety locking folding knife engagement lock has been illustrated and described and it will be apparent to those skilled in the art that various changes and modifications may be made thereto without departing from the spirit of the invention.

Therefore, I claim:

1. A folding knife comprises, an elongated handle, an elongated knife blade having a sharp edge portion and a contoured end shank portion, the knife blade pivotally secured within said handle from a first closed retained position to a second open locked position, a blade locking and retainment pin movably positioned independently within said elongated handle for contact engagement with said contoured end shank portion from said first closed retained position to said second open locked position, said blade locking and retainment pin slidably positioned in guide slots in said handle portions, a spring urged safety release locking arm within said handle having a depending locking arm projection with a flat end and a right-angled return bottom edge surface for selective edge surface pin engagement in continuous engagement against said blade locking and retainment pin allowing for independent repositioning thereof of said locking and retainment pin within said guide slots.

2. The folding knife set forth in claim 1 wherein said handle has a fixed blade pin stop for registration against said blade contoured end shank portion and within a blade stop pin receiving notch in said safety release locking arm.

3. The folding knife set forth in claim 1 wherein said safety release locking arm is bifurcated, a spring resiliently positioned within and engaging said bifurcated locking arm, a spring stop guide arm pin in said handle registerable with said spring and within a portion of said bifurcated locking arm.

4. The folding knife set forth in claim 1 wherein said elongated handle has handle portions with a handle spacer there between.

5. The folding knife set forth in claim 1 wherein said blade shank portion has an arcuate end surface defining a shank locking tab and a shank retaining notch in spaced arcuate relation for selective engagement by said blade locking and retainment pin dependent on blade open locked or blade closed retained position and said independent locking pin position.

* * * * *